US008235312B2

(12) United States Patent
Suda et al.

(10) Patent No.: US 8,235,312 B2
(45) Date of Patent: Aug. 7, 2012

(54) ELECTROSTATIC ATOMIZER

(75) Inventors: Hiroshi Suda, Takatsuki (JP); Takayuki Nakada, Hikone (JP); Masaharu Machi, Shijonawate (JP); Tomohiro Yamaguchi, Moriyama (JP); Sumio Wada, Hikone (JP)

(73) Assignee: Panasonic Corporation, Osaka (JP)

( * ) Notice: Subject to any disclaimer, the term of this patent is extended or adjusted under 35 U.S.C. 154(b) by 566 days.

(21) Appl. No.: 12/518,908

(22) PCT Filed: Dec. 12, 2007

(86) PCT No.: PCT/JP2007/074350

§ 371 (c)(1),
(2), (4) Date: Jul. 27, 2009

(87) PCT Pub. No.: WO2008/072771

PCT Pub. Date: Jun. 19, 2008

(65) Prior Publication Data

US 2010/0025505 A1 Feb. 4, 2010

(30) Foreign Application Priority Data

Dec. 15, 2006 (JP) ..... 2006-338880

(51) Int. Cl.
*B05B 5/00* (2006.01)

(52) U.S. Cl. ..... 239/690; 239/690.1

(58) Field of Classification Search ..... 239/690, 239/690.1, 697, 701, 706, 707
See application file for complete search history.

(56) References Cited

U.S. PATENT DOCUMENTS

| | | | | |
|---|---|---|---|---|
| 4,921,172 | A * | 5/1990 | Belmain et al. | 239/698 |
| 7,314,185 | B2 * | 1/2008 | Nishi et al. | 239/102.1 |
| 2003/0015594 | A1 * | 1/2003 | Kelly | 239/3 |
| 2004/0118953 | A1 * | 6/2004 | Elrod et al. | 239/690 |
| 2006/0064892 | A1 | 3/2006 | Matsui et al. | |
| 2006/0201016 | A1 * | 9/2006 | Nakagawa et al. | 34/96 |
| 2009/0078800 | A1 | 3/2009 | Nakasone et al. | |

FOREIGN PATENT DOCUMENTS

| | | |
|---|---|---|
| JP | 2006-68711 | 3/2006 |
| JP | 2006-122819 | 5/2006 |
| JP | 2006-20513 | 8/2006 |
| JP | 2006-205013 | 8/2006 |
| JP | 2006-272041 | 10/2006 |

OTHER PUBLICATIONS

English language Abstract of JP 2006-68711, Mar. 16,2006.
U.S. Appl. No. 12/518,913 to Wada et al., which was filed on Jun. 12, 2009.

* cited by examiner

*Primary Examiner* — Davis Hwu
(74) *Attorney, Agent, or Firm* — Greenblum & Bernstein, P.L.C.

(57) ABSTRACT

Disclosed is an electrostatic atomizer, which comprises a high-voltage applying section adapted to apply a high voltage between an atomizing electrode and a counter electrode so as to electrostatically atomize water supplied onto the atomizing electrode, wherein the high-voltage applying section is operable to set an absolute value of a voltage to be applied to the atomizing electrode smaller than an absolute value of a voltage to be applied to the counter electrode. This allows a physical object, such as an article stored in a mist-receiving space or an inner wall of a structural member defining the mist-receiving space to become less likely to be electrostatically charged, and makes it possible to avoid causing a problem about discomfort due to discharge of static charges when a user touches the physical object.

5 Claims, 7 Drawing Sheets

ELECTROSTATIC ATOMIZER

TECHNICAL FIELD

The present invention relates to an electrostatic atomizer adapted to generate nanometer-size charged fine water droplets by an electrostatic atomization phenomenon and supply fine water droplets to a mist-receiving space.

BACKGROUND ART

There has been proposed an electrostatic atomizer comprising an atomizing electrode, a counter electrode disposed in opposed relation to the atomizing electrode, and water supplier for supplying water onto the atomizing electrode, wherein a high-voltage is applied between the atomizing electrode and the counter electrode to atomize water held on the atomizing electrode so as to generate charged fine water droplets in a nanometer size range and in a high charge state (i.e., nanometer-size electrostatically charged or ionized misty droplets), as disclosed in the following Patent Publication 1.

Typically, this type of electrostatic atomizer disclosed in the Patent Publication 1 and others has been designed such that, after a potential of the counter electrode is set at a ground potential (zero V) as a precondition to applying an voltage in such a manner as to set a potential difference between the atomizing electrode and the counter electrode at a desired value for electrostatically atomizing water supplied onto the atomizing electrode, the voltage is applied to allow the atomizing electrode to have a potential of about minus 5 kV when it is intended to produce negatively-charged fine water droplets, or the voltage is applied to allow the atomizing electrode to have a potential of about plus 5 kV when it is intended to produce positively-charged fine water droplets.

This operation will be more specifically described with reference to a schematic diagram illustrated in FIG. 7. As shown in FIG. 7, when a voltage is applied between an atomizing electrode 2 and a counter electrode 3 to allow the atomizing electrode 2 and the counter electrode 3 to be set at +5 kV and a ground voltage (zero V), respectively, water W supplied onto the atomizing electrode 2 is electrostatically atomized to produce negatively-charged fine water droplets M and negative ions I.

In the above situation, the counter electrode is set at zero V, and a physical object C, such as an article stored in a mist-receiving space or an inner wall of a structural member defining the mist-receiving space, has an approximately zero V. Thus, most of the negative ions I produced and released into the mist-receiving space during the electrostatic atomization are likely to drift in the mist-receiving space without attaching onto the counter electrode 3, and excessively attach onto the physical object C, causing the physical object C to become electrostatically charged. Particularly, in cases where the mist-receiving space is a small volume of closed space, such as a vegetable or cooling compartment of a refrigerator, a shoes storage, a clothes washer or a dishwasher, static electrification of a physical object C due to attachment of negative ions I drifting in the small volume of closed space becomes prominent. This causes a problem that, if a user touches the physical object C by his/her hand, the static charges will be discharged through the hand to make his/her feel uncomfortable.

[Patent Publication 1] Japanese Unexamined Patent Publication No. 2006-68711

DISCLOSURE OF THE INVENTION

In view of the above problems of the prior art, it is an object of the present invention to provide an electrostatic atomizer which can make a physical object, such as an article stored in a mist-receiving space or an inner wall of a structural member defining the mist-receiving space, less likely to be electrostatically charged.

In order to achieve the above object, the present invention provides an electrostatic atomizer which comprises a high-voltage applying section adapted to apply a high voltage between an atomizing electrode and a counter electrode so as to electrostatically atomize water supplied onto the atomizing electrode. In this electrostatic atomizer, the high-voltage applying section is operable to set an absolute value of a voltage to be applied to the atomizing electrode smaller than an absolute value of a voltage to be applied to the counter electrode.

These and other objects, features, aspects, and advantages of the present invention will become more apparent from the following detailed description of the preferred embodiments/examples with reference to the accompanying drawings.

BEST MODE FOR CARRYING OUT THE INVENTION

An embodiment of the present invention will now be described with reference to the accompanying drawings.

An electrostatic atomizer comprises an atomizing electrode 2, a counter electrode 3 disposed in opposed relation to the atomizing electrode 2, a water supplier 15 adapted to supply water onto the atomizing electrode 2, and a high-voltage applying section 9 adapted to apply a high voltage between the atomizing electrode 2 and the counter electrode 3.

It is contemplated to use various types of water supply systems as the water supplier 15 to supply water onto the atomizing electrode 2. For example, the water supplier 15 may be designed to condense moisture in air so as to supply water onto the atomizing electrode 2 or may be designed to supply water from a water reservoir onto a tip end of the atomizing electrode 2 by means of a capillary phenomenon or using a force feed system (including force feed based on a pump).

Figure 1:
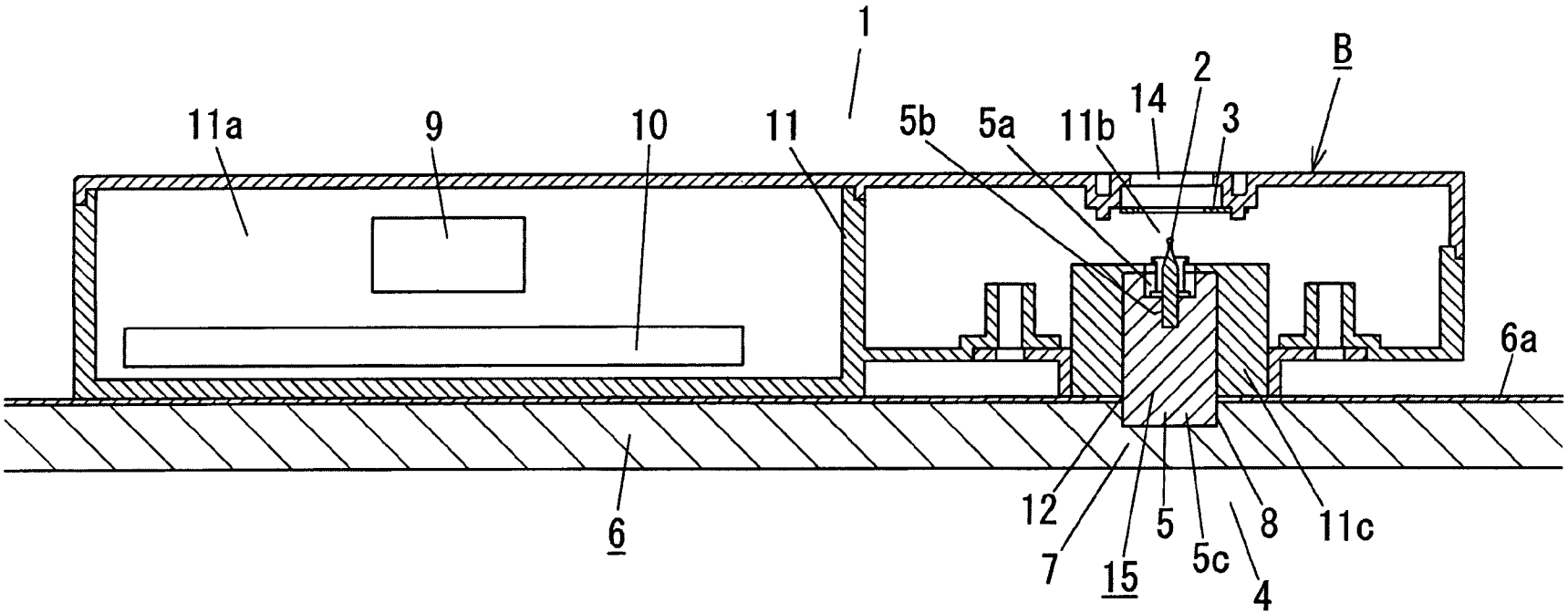
FIG. 1 is a longitudinal-sectional view showing an electrostatic atomizer according to an embodiment of the present invention.
Figure 2:
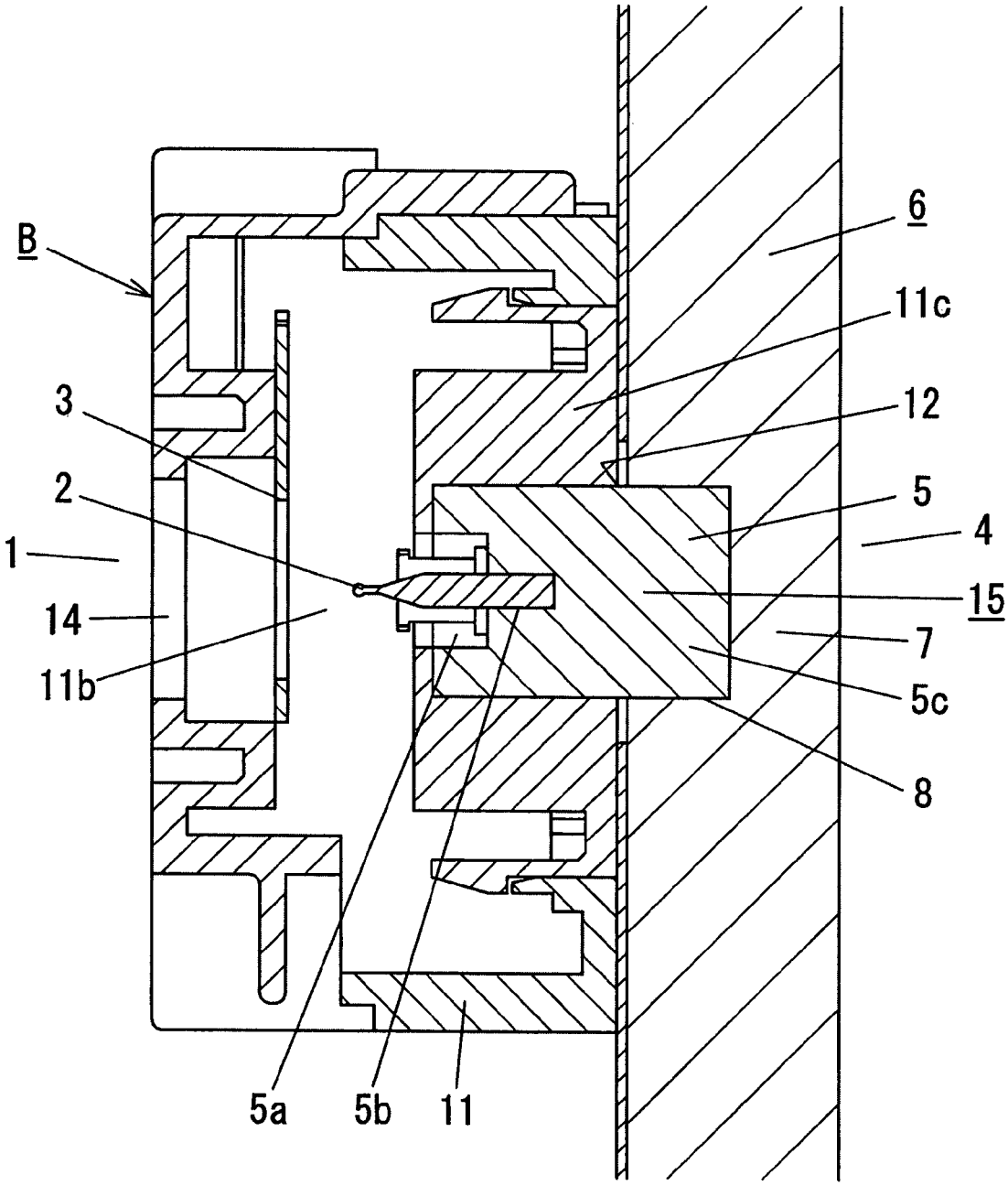
FIG. 2 is an enlarged cross-sectional view of a main unit of the electrostatic atomizer.
Figure 3:
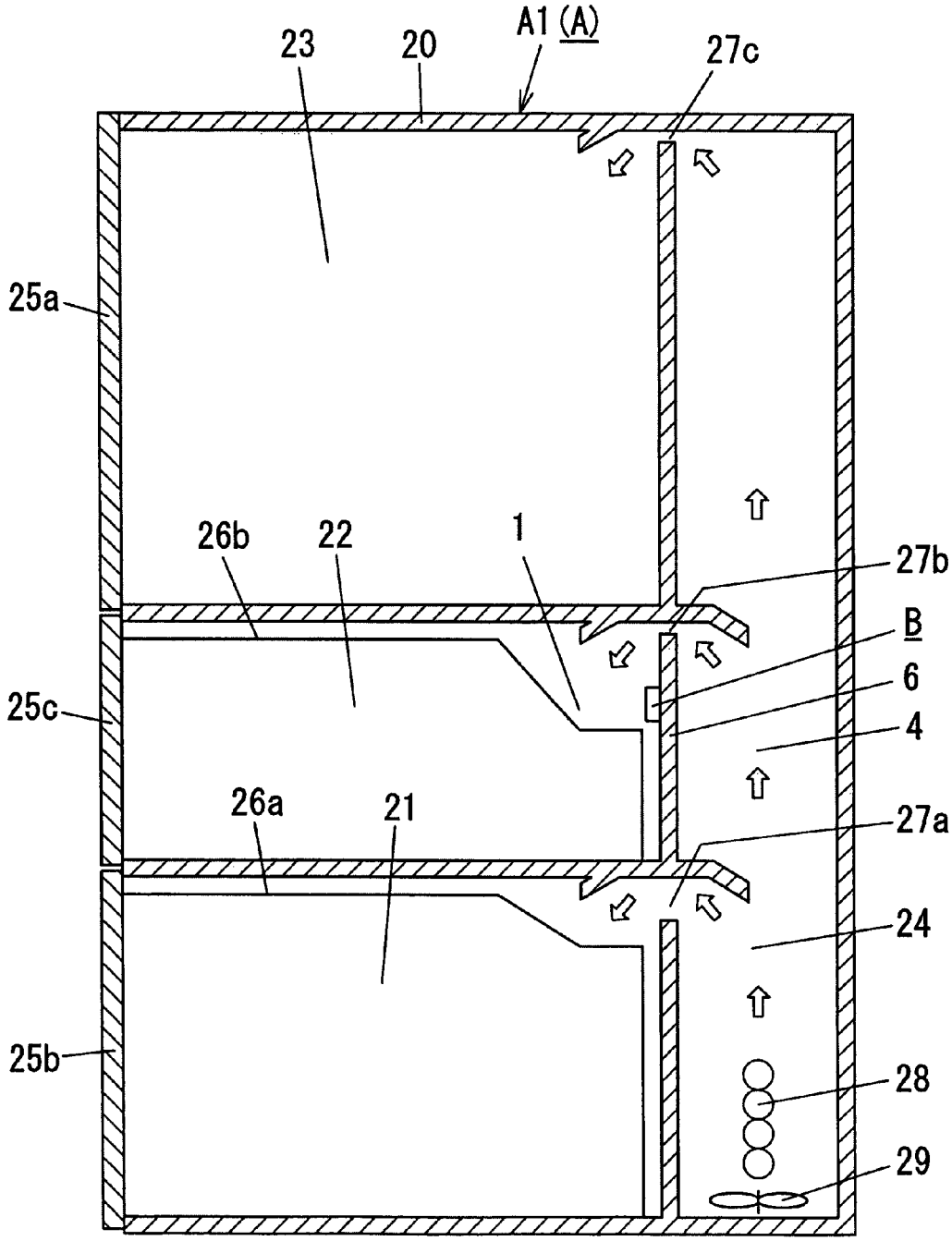
FIG. 3 is a schematic diagram showing an internal structure of an apparatus using the electrostatic atomizer illustrated in FIG. 1.

Referring to FIGS. 1 to 3 showing the electrostatic atomizer according to the embodiment, the water supplier 15 is designed to condense moisture in air so as to supply water onto the atomizing electrode 2.

In the embodiment illustrated in FIGS. 1 to 3, an apparatus A using the electrostatic atomizer internally has a mist-receiving space 1, and a cold space 4 disposed adjacent to the mist-receiving space 1 and kept at a temperature lower than that of the mist-receiving space 1. The apparatus A is intended to supply nanometer-size charged fine water droplets produced by electrostatic atomization, to the mist-receiving space 1. For example, the apparatus A having the mist-receiving space 1 and the cold space 4 may include a refrigerator and an air-conditioner.

Although the first embodiment illustrated in FIGS. 1 to 3 will be described by taking a refrigerator A1 as one example of the apparatus A having the mist-receiving space 1 and the cold space 4, an apparatus suitable for applying the inventive electrostatic atomizer is not limited to the refrigerator A1.

FIG. 3 is a schematic diagram showing an internal structure of the refrigerator A1. In FIG. 3, the refrigerator A1 comprises a refrigerator housing 20 which is internally provided with a freezing compartment 21, a vegetable compartment 22, a cooling compartment 23 and a cold-air passage 24. In an outer shell of the refrigerator housing 20, each of the freezing compartment 21, the vegetable compartment 22, the cooling compartment 23 and the cold-air passage 24 is divided by a partition wall 6. The partition wall 6 is made of a heat-insulating material. Further, an outer skin 6*a* formed of a synthetic-resin molded product is integrally laminated on a surface of the partition wall 6. Portion of the partition wall 6 dividing between the cold-air passage 24 and respective ones of the freezing compartment 21, the vegetable compartment 22 and the cooling compartment 23 are formed, respectively, with communication holes 27*a*, 27*b*, 27*c* for providing fluid communication between the cold-air passage 24 and respective ones of the freezing compartment 21, the vegetable compartment 22 and the cooling compartment 23.

Each of the freezing compartment 21, the vegetable compartment 22 and the cooling compartment 23 has an opening on a front side (in FIG. 3, left side) of the refrigerator A1. The front opening of the cooling compartment 23 is provided with a door 25*a* attached thereto through a hinge in a swingably openable and closable manner. The freezing compartment 21 and the vegetable compartment 22 are provided, respectively, with drawer-type boxes 26*a*, 26*b* in an extractable and insertable manner. The drawer boxes 26*a*, 26*b* are integrally formed, respectively, with doors 25*b*, 25*c* at respective front ends thereof. Specifically, each of the drawer boxes 26*a*, 26*b* is adapted, when it is fully inserted and received into/in a corresponding one of the freezing compartment 21 and the vegetable compartment 22, to close the front opening of the corresponding one of the freezing compartment 21 and the vegetable compartment 22 by the door (26*a*, 26*a*) formed at the front end of the drawer box (26*a*, 26*b*).

The cold-air passage 24 is internally provided with a cooling source 28 and a fan 29. The cooling source 29 is operable to cooled air in the cold-air passage 24 (e.g., cool to about −20° C.), and the fan 29 is operable to supply the cooled air in the cold-air passage 24 to each of the freezing compartment 21, the vegetable compartment 22 and the cooling compartment 23 through a corresponding one of the communication holes 27*a*, 27*b*, 27*c*. Each of the freezing compartment 21, the vegetable compartment 22 and the cooling compartment 23 is set at a desired temperature according to the cooled air supplied thereto. More specifically, each of the desired temperatures of the vegetable compartment 22 and the cooling compartment 23 is greater than the desired temperature of the freezing compartment 21 (e.g., the desired temperature of the vegetable compartment 22 is about 5° C.). Thus, each of the communication holes 27*b*, 27*c* is formed to have an opening area smaller than that of the communication hole 27*a* so as to reduce a volume of cooled air from the cold-air passage into each of the vegetable compartment 22 and the cooling compartment 23, as compared with the freezing compartment 21.

Although not illustrated, each of the freezing compartment 21, the vegetable compartment 22 and the cooling compartment 23 is provided with a return passage for returning air to an upstream side of the cold-air passage 24 relative to the cooling source 28.

For example, in the above refrigerator A1, the vegetable compartment 22 and/or the cooling compartment 23 serve as the mist-receiving space 1, and the cold-air passage 24 adjacent to the vegetable compartment 22 and the cooling compartment 23 through the partition wall 6 made of a heat-insulating material serves as the cold space 4 having a temperature lower than that of the mist-receiving space 1 (in the embodiment illustrated in FIGS. 1 to 3, the vegetable compartment 22 serves as the mist-receiving space 1).

A main unit B of the electrostatic atomizer (hereinafter referred to simply as "atomizer main unit B") according to the embodiment is mounted to a surface of the portion of the partition wall 6 dividing between the vegetable compartment 22 (i.e., the mist-receiving space 1) and the cold-air passage 24 (i.e., the cold space 4), on the side of the mist-receiving space 1.

The atomizer main unit B comprises an atomizing electrode 2, a counter electrode 3, a high-voltage applying section 9 adapted to apply a high voltage between the atomizing electrode 2 and the counter electrode 3, a control section 10 adapted to control an electrostatic atomization operation, and an atomizer housing 11 receiving therein the above components.

The atomizer housing 11 is divided into a receiving chamber 11*a* receiving therein the high-voltage applying section 9 and the control section 10, and a discharge chamber 11*b*. The receiving chamber 11*a* receiving therein the high-voltage applying section 9 and the control section 10 is formed as a closed (i.e., hermetically sealed) chamber designed to prevent foreign substances, such as water, from getting thereinto from outside. The atomizing electrode 2 and the counter electrode 3 are disposed in the discharge chamber 11*b*. The counter electrode 3 is formed of a doughnut-shaped metal plate, and mounted to a portion of the discharge chamber 11*b* on the front side of the refrigerator A1 in such a manner as to be disposed inside the discharge chamber 11*b* and in opposed relation to a mist-releasing opening 24 formed in a front wall of the atomizer housing 11. The atomizing electrode 2 is mounted to a rear wall of the discharge chamber 11*b*. The atomizing electrode 2 is positioned to allow a pointed portion at a tip end thereof to be located coaxially with a center axis of a center hole of the doughnut-shaped counter electrode 3. Each of the atomizing electrode 2 and the counter electrode 3 is electrically connected to the high-voltage applying section 9 through a high-voltage lead wire.

The atomizing electrode 2 is provided with a heat transfer member 5 made of a material having excellent heat conductivity, such as metal, and located at a rear end thereof to serve as one element of the water supplier 15. The atomizing electrode 2 and the heat transfer member 5 may be integrally formed as a single piece. Alternatively, the heat transfer member 5 may be formed separately from the atomizing electrode 2 and then fixedly attached to the atomizing electrode 2, or the heat transfer member 5 may be formed separately from the atomizing electrode 2 and then brought into contact with the atomizing electrode 2. In either case, the atomizing electrode 2 and the heat transfer member 5 are formed in a structure which allows heat to be efficiently transferred therebetween.

The heat transfer member 5 is mounted to the atomizer housing 11 (in the embodiment, the heat transfer member 5 is mounted to a cap member 11*c* forming a part of the rear wall of the atomizer housing 11, as shown in FIGS. 1 and 2. The rear wall of the atomizer housing 11 is formed with a hole 12 (in the embodiment, the hole 12 is formed in the cap member 11*c*, as shown in FIGS. 1 and 2). The heat transfer member 5 has a rear end facing the hole 12. In the embodiment, the heat transfer member 5 is arranged such that the rear end thereof protrudes from the hole 12, as shown in FIGS. 1 and 2. Alternatively, the heat transfer member 5 is arranged such that an end face thereof does not protrude rearwardly from the hole 12.

The partition wall 6 has a portion 7 having higher heat conductivity than the remaining portion. For example, the highly heat-conductive portion 7 may be created by partly reducing a wall thickness of the partition wall 6 made of a heat-insulating material, or by making a part of the partition wall 6 from a material having a higher heat conductivity than of a material of the remaining part of the partition wall 6, or by forming a communication hole providing fluid communication between the mist-receiving space 1 and the cold space 4, in a part of the partition wall 6 made of a heat-insulating material, so as to increase heat conductivity.

In the structure where the partition wall 6 is partly thinned to form the highly heat-conductive portion 7, a concave portion 8 may be formed in the partition wall 6 to partly thin the partition wall 6 in an easy manner. In this case, the concave portion 8 may be formed in a surface of the partition wall 6 on the side of the mist-receiving space 1, or may be formed in a surface of the partition wall 6 on the side of the cold space 4. Alternatively, the concave portion 8 may be formed in both the surfaces on the respective sides of the mist-receiving space 1 and the cold space 4. In the embodiment, a hole is formed in a portion of the outer skin 6*a* corresponding to around the highly heat-conductive portion 7 to allow the heat-insulating material to be exposed to the mist-receiving space 1.

As above, the partition wall 6 is formed with the concave portion 8 to have the highly heat-conductive portion 7 with a reduced wall thickness. In an operation of mounting the atomizer housing 11 to the surface of the partition wall 6 on the side of the mist-receiving space 1, the heat transfer member 5 is positioned to be in contact with the highly heat-conductive portion 7, or positioned with a small distance relative to the highly heat-conductive portion 7. While the rear end of the heat transfer member 5 in the embodiment is fitted in the concave portion 8, as shown in FIG. 1, the present invention is not limited to this structure/arrangement, but may have any other suitable structure/arrangement capable of facilitating heat transfer in the partition wall 6.

In the structure where the concave portion 8 is formed in the surface of the partition wall 6 on the side of the mist-receiving space 1 to form the highly heat-conductive portion 7, the protruding portion 5*c* of the heat transfer member 5 protruding from the hole 12 is inserted into the concave portion 8, as shown in FIGS. 1 and 2. This makes it possible to more effectively perform the heat transfer between the heat transfer member 5 and the cold space 4.

The heat transfer member 5 of the atomizing electrode 2 is disposed in opposed relation to the highly heat-conductive portion 7 formed in a part of the partition wall 6, as mentioned above. Thus, even though the mist-receiving space 1 and the cold space 4 is thermally insulated from each other by the partition wall 6 made of a heat-insulating material, only the heat transfer member 5 can be cooled to a temperature lower than that of each region and each of the remaining components of the atomizer main unit B installed in the mist-receiving space 1, so as to reduce the temperature of the atomizing electrode 2 while cooling moisture contained in air in the discharge chamber 11*b*, to create condensed water on the atomizing electrode 2. In this manner, water will be stably supplied onto the atomizing electrode 2.

In the above state when water is supplied onto the atomizing electrode 2, the high-voltage applying section 9 is operable to apply a voltage between the atomizing electrode 2 and the counter electrode 3 in such a manner as to allow a potential difference between the atomizing electrode 2 and the counter electrode 3 to be set at a given value. According to the high voltage applied between the atomizing electrode 2 and the counter electrode 3, a Coulomb force acts between the counter electrode, and the water supplied on the tip end of the atomizing electrode 2, to form a locally raised cone-shaped portion (Taylor cone) in a surface of the condensed water. Due to the formation of the Taylor cone, electric charges are concentrated in a tip of the Taylor cone to increase an electric field intensity and thereby increase the Coulomb force to be produced at the tip of the Taylor cone so as to accelerate growth of the Taylor cone. When electric charges are concentrated at the tip of the Taylor cone grown in this manner, to increase an electric charge density, large energy (repulsive force of the highly-desified electric charges) will be applied to a tip portion of Taylor cone-shaped water at a level greater than a surface tension of the water to cause repetitive breakup/scattering (Rayleigh breakup) of the water so as to produce a large amount of nanometer-size charged fine water droplets.

The nanometer-size charged fine water droplets produced in the above manner are released from the mist-releasing opening 14 formed in the front wall of the atomizer housing 11, into the mist-receiving space 1 through the center hole of the counter electrode 3. Each of the nanometer-size charged fine water droplets released into the mist-receiving space 1 has a nanometer-scale extremely small size, and therefore can drift in air for a long period of time with high diffusion capability. Thus, the nanometer-size charged fine water droplets will drift in every corner of the mist-receiving space 1 and attach onto a physical object C, such as an inner wall of a structural member defining the mist-receiving space 1 and an article stored in the mist-receiving space 1. In addition, active species contained in the nanometer-size charged fine water droplets exist in such a manner as to be wrapped with water molecules so as to have a deodorizing effect, a sterilization effect on molds and bacteria, and a suppressive effect on propagation thereof. Thus, the nanometer-size charged fine water droplets attached onto a physical object C, such as an inner wall of a structural member defining the mist-receiving space 1 and an article stored in the mist-receiving space 1, will exhibit the deodorizing effect, the sterilization effect on molds and bacteria, and the suppressive effect on propagation thereof. Further, the active species contained in the nanometer-size charged fine water droplets in such a manner as to be wrapped with water molecules have a longer life as compared with active species existing in the form of a free radical. This makes it possible to enhance the deodorizing effect, the sterilization effect on molds and bacteria, and the suppressive effect on propagation thereof. Furthermore, the nanometer-size charged fine water droplets have a moisturizing effect, and can effectively retain a moisture content of an article stored in the mist-receiving space 1.

In the operation of applying a high voltage between the atomizing electrode 2 and the counter electrode 3 to electrostatically atomize water supplied onto the atomizing electrode 2, the electrostatic atomizer according to the embodiment is operable to apply the voltage between the atomizing electrode 2 and the counter electrode 3 in such a manner as to allow a potential of the counter electrode 3 to become greater than that of the atomizing electrode 2 by about 5 kV. Further, in the operation of effectively electrostatically atomizing water supplied onto the tip end of the atomizing electrode 2 to produce nanometer-size charged fine water droplets, the electrostatic atomizer according to the embodiment is operable to allow an absolute value of a voltage of the counter electrode 3 to become greater than an absolute value of a voltage of the atomizing electrode 2 (i.e., to allow a potential of the atomizing electrode 2 to be set at a ground potential (zero V), or to allow the potential of the atomizing electrode 2 to be set at a value closer to a ground potential (zero V) than a potential of the counter electrode 3).

Figure 4:
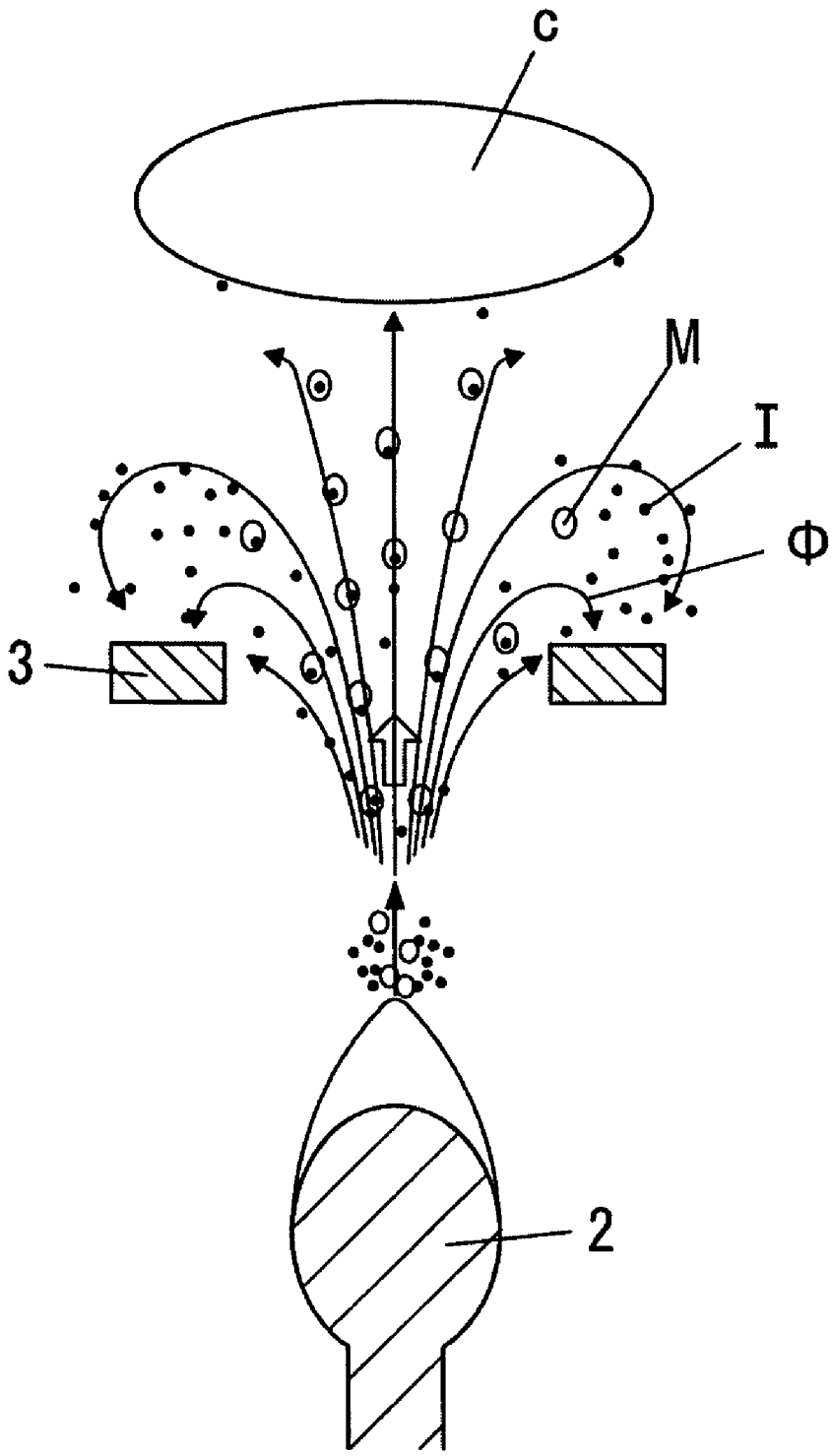
FIG. 4 is a schematic explanatory diagram of an operation of applying a voltage between an atomizing electrode and an counter electrode in such a manner as to allow a potential difference between an atomizing electrode and an counter electrode to be set at a given value for electrostatically atomizing water supplied onto the atomizing electrode, wherein a potential of the atomizing electrode is set at a ground potential or at a value closer to the ground potential than a potential of the counter electrode.

With reference to FIG. 4, an operation of the electrostatic atomizer according to the embodiment will be made about one example where a given voltage (e.g., 5 kV) is applied between the atomizing electrode 2 and the counter electrode 3 in such a manner as to allow the potential of the atomizing electrode 2 to set at the ground potential (zero V), or to be set at a value closer to the ground potential (zero V) than the potential of the counter electrode 3, and generate negative ions by the atomizing electrode 2.

In FIG. 4, the potential of the counter electrode 3 is set at +5 kV, and the potential of the atomizing electrode 2 is set at zero V, by way of example. That is, the counter electrode 3 becomes a positive electrode. Thus, most of negative ions I generated by the atomizing electrode 2 will attach onto the counter electrode 4, i.e., a positive electrode, to prevent the negative ions I generated during electrostatic atomization from excessively attaching onto the physical object C, such as an inner wall of a structural member defining the mist-receiving space 1 and an article stored in the mist-receiving space 1. This allows the physical object C to become less likely to be electrostatically charged, and makes it possible to avoid causing discomfort due to static charges even if a user touches the physical object C by his/her hand.

Although not illustrated, in an operation of applying a voltage between the atomizing electrode 2 and the counter electrode 3 to generate positive ions by the atomizing electrode 2, the counter electrode 3 becomes a negative electrode. Thus, most of positive ions generated by the atomizing electrode 2 will attach onto the counter electrode 4, i.e., a negative electrode, to prevent the positive ions from excessively attaching onto the physical object C, such as an inner wall of a structural member defining the mist-receiving space 1 and an article stored in the mist-receiving space 1. This allows the physical object C to become less likely to be electrostatically charged, and makes it possible to avoid causing discomfort due to static charges even if a user touches the physical object C by his/her hand.

In either case, while each of the negatively- or positively-charged fine water droplets has a nanometer-size extremely small size, it has a fairly greater mass than that of the negative ion I (or the positive ion). Thus, in response to a migration force given by an electric flux line F, the charged fine water droplets are inertially released into the mist-receiving space 1. Then, the charged fine water droplets will attach onto the physical object C including not only an inner wall of a structural member defining the mist-receiving space 1 but also an article stored in the mist-receiving space 1, while drifting in the mist-receiving space 1. This makes it possible to effectively perform sterilization, antibacterial action, deodorization, moisturization, etc.

As described above, the electrostatic atomizer according to the embodiment can reduce an amount of negative ions (or positive ions) attaching onto the physical object C, such as an inner wall of a structural member defining the mist-receiving space 1 and an article stored in the mist-receiving space 1, so as to prevent occurrence of troubles due to static electrification of the physical object C, and discomfort due to discharge of static charges. Thus, the electrostatic atomizer is suitable, particularly, for the operation of releasing charged fine water droplets M generated by electrostatic atomization, into a small volume of closed space, such as the vegetable or cooling compartment of the refrigerator 1A, which would otherwise involve a problem about static electrification of the physical object C, such as an inner wall of a structural member defining the mist-receiving space 1.

While the embodiment has been described based on one example where a voltage is applied to allow respective potentials of the atomizing electrode 2 and the counter electrode 3 to be set at zero V and +5 kV, respectively, the present invention is not limited to such an operation, but may be any other suitable operation to be performed on the assumption that a voltage is applied between the atomizing electrode 2 and the counter electrode 3 in such a manner as to allow a potential difference between the atomizing electrode 2 and the counter electrode 3 to be set at a given value for electrostatically atomizing water supplied onto the atomizing electrode 2, wherein a potential of the atomizing electrode 2 is set at a ground potential (zero V) or at a value closer to the ground potential (zero V) than a potential of the counter electrode 3. Preferably, a voltage is applied in such a manner that an absolute value of a voltage to be applied to the atomizing electrode 2 smaller than that of the counter electrode 3 is set within ±1 kV, and an absolute value of a voltage of the counter electrode 3 becomes greater than that of the atomizing electrode 2. In this case, an effect of preventing electric shock due to an electrostatically charged physical object, can be obtained in addition to the aforementioned effect of reducing static electrification.

Figure 5:
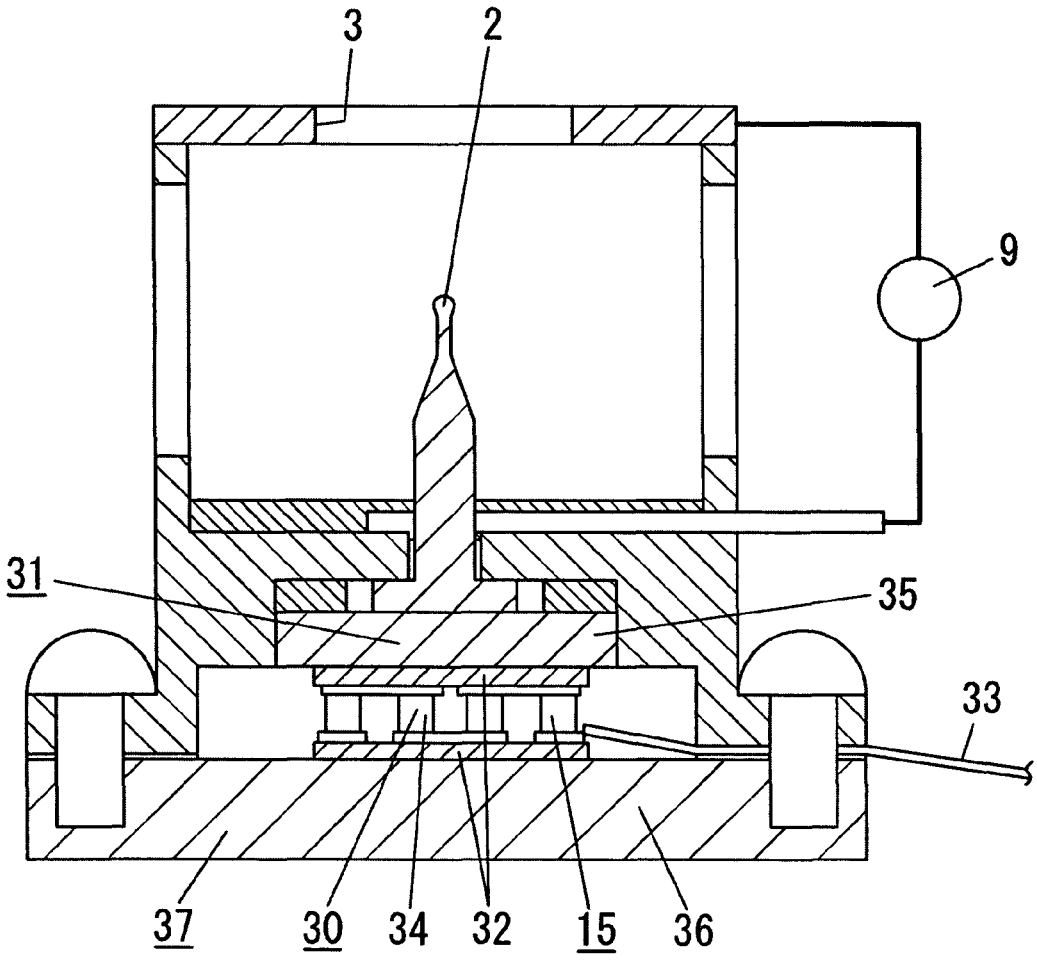
FIG. 5 is a schematic sectional view showing an electrostatic atomizer according to another embodiment of the present invention.

FIG. 5 shows an electrostatic atomizer according to a second embodiment of the present invention, wherein the second embodiment is different from the previous first embodiment in a structure of water supplier 15 for condensing moisture in air and supply the condensed water to an atomizing electrode 2.

In the second embodiment illustrated in FIG. 5, the water supplier 15 has a structure where the atomizing electrode 2 is thermally connected to a cooling section 31 of a Peltier unit 30.

In the Peltier unit 30, a pair of Peltier circuit boards 32 each comprising an electrical insulation substrate made of a material having high heat conductivity, such as alumina or aluminum nitride, and a circuit formed on one surface of the electrical insulation substrate, are disposed to allow the respective circuits to be located in opposed relation to each other. A large number of n-type and p-type BiTe-based thermoelectric elements 34 disposed in an alternate arrangement are sandwiched between the Peltier circuit boards 32. Respective one ends of the adjacent thermoelectric elements 34 are electrically connected in series through a corresponding one of the opposed circuits. The Peltier unit 30 is adapted, in response to supplying a current to the thermoelectric elements 34 through a Peltier input lead wire 33, to transfer heat from the side of one of the Peltier circuit boards 32 toward the other Peltier circuit board 32. A cooling electrical insulation plate 35 made of a material having high heat conductivity and high electric resistance, such as alumina or aluminum nitride, is thermally connected to an upper surface of one (hereinafter referred to as "cooling-side Peltier circuit board") of the Peltier circuit boards 32. Further, a heat release plate 36 made of a material having high heat conductivity and high electric resistance, such as alumina or aluminum nitride, is thermally connected to a lower surface of the other Peltier circuit board 32 (hereinafter referred to as "heat release-side Peltier circuit board").

In the second embodiment, the cooling section 31 is made up of the electrical insulation substrate of the cooling-side Peltier circuit board 32, and the cooling electrical insulation plate 35, and a heat release section 37 is made up of the electrical insulation substrate of the heat release-side Peltier circuit board 32, and the heat release plate 36, wherein heat is transferred from the side of the cooling section 31 toward the heat release section 37 through the thermoelectric elements 34.

Thus, the water supplier 15 is adapted, in response to supplying a current to the Peltier unit 30, to cool the atomizing electrode 2 thermally connected to the cooling section 31 so as to condense moisture in air to supply the condensed water onto the atomizing electrode 2.

In an operation of applying a voltage between the atomizing electrode 2 and the counter electrode 3 in such a manner as to allow a potential difference between the atomizing electrode 2 and the counter electrode 3 to be set at a given value for electrostatically atomizing water supplied onto the atomizing electrode 2, the electrostatic atomizer according to the second embodiment illustrated in FIG. 5 is operable to allow a potential of the atomizing electrode 2 to be set at a ground potential or at a value closer to the ground voltage than that of a potential of the counter electrode 3, in the same manner as that in the first embodiment.

Preferably, in the second embodiment, a voltage is applied in such a manner that an absolute value of a voltage to be applied to the atomizing electrode 2 smaller than that of a voltage of the counter electrode 3 is set within ±1 kV, and an absolute value of a voltage of the counter electrode 3 becomes greater than that of a voltage of the atomizing electrode 2, as with the first embodiment.

Figure 6:
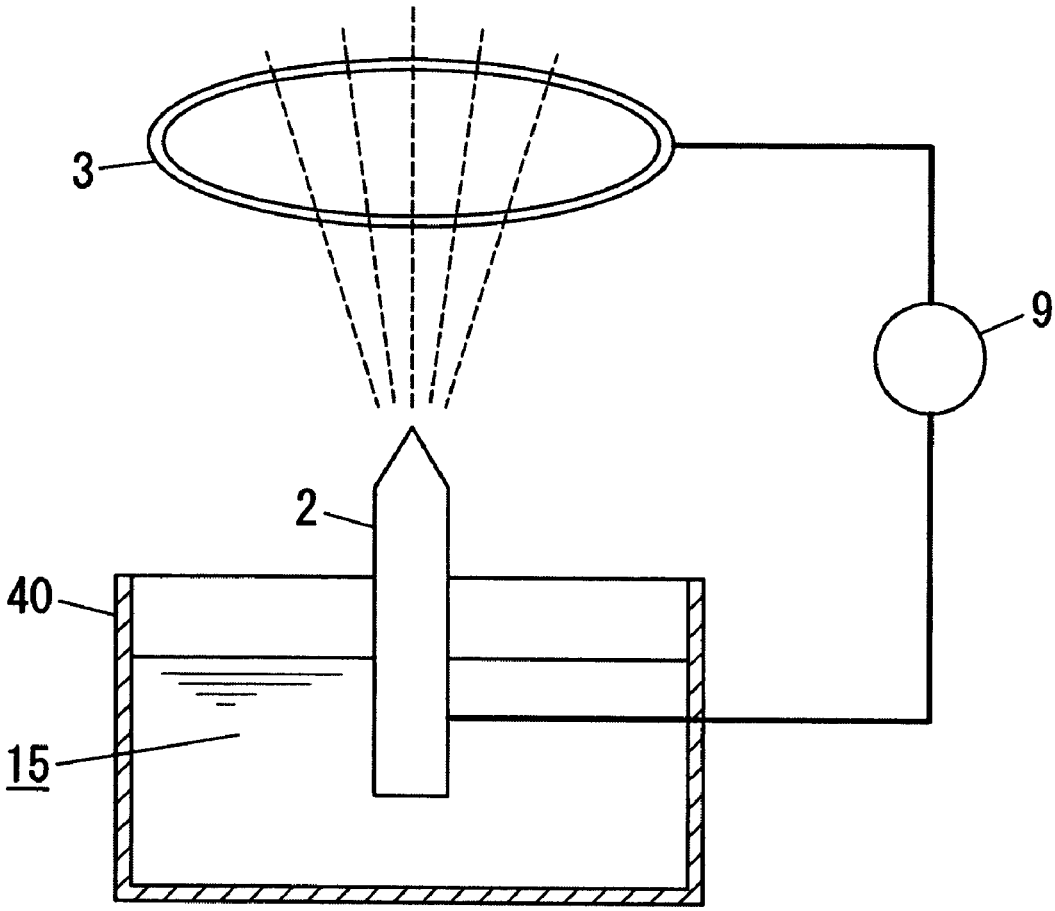
FIG. 6 is a schematic sectional view showing an electrostatic atomizer according to yet another embodiment of the present invention.
Figure 7:
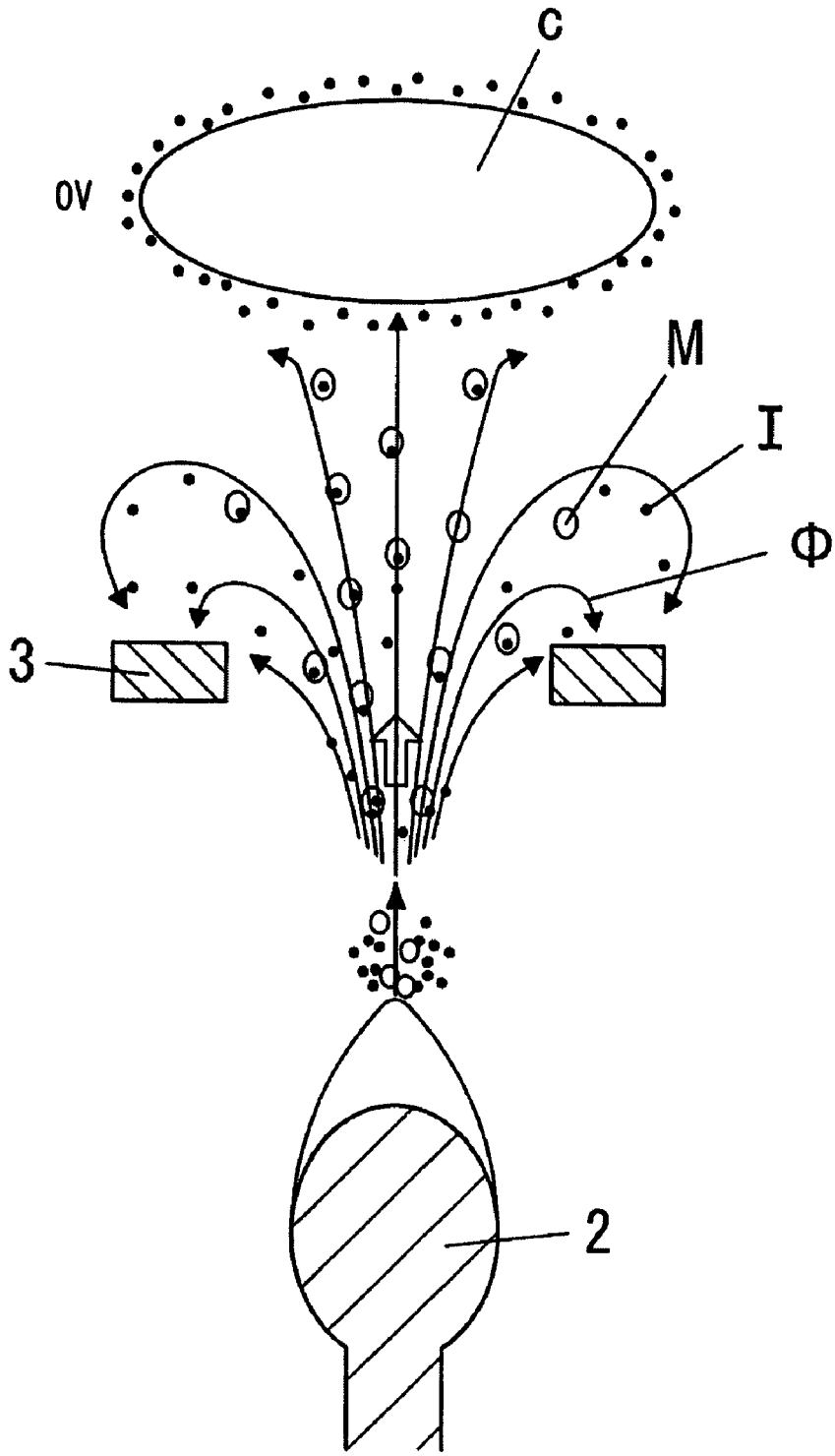
FIG. 7 is a schematic explanatory diagram showing a conventional electrostatic atomizer.

FIG. 6 shows an electrostatic atomizer according to a third embodiment of the present invention, wherein the third embodiment is different from the first and second embodiments in a structure of water supplier 15 for supplying water to an atomizing electrode 2.

The water supplier 15 in the third embodiment illustrated in FIG. 6 is adapted to store a liquid in a water reservoir 40 for reserving water (liquid) therein, and supply the water to a tip end of the atomizing electrode 2 by mans of a capillary phenomenon. In the embodiment, the atomizing electrode 2 is formed with a small hole or a porous portion to induce the capillary phenomenon so as to supply the water based on the capillary phenomenon. If the water reservoir 40 is located away from the atomizing electrode 2, the water may be supplied from the water reservoir 40 to the atomizing electrode 2 through a water transport member capable of inducing a capillary phenomenon.

In an operation of applying a voltage between the atomizing electrode 2 and the counter electrode 3 in such a manner as to allow a potential difference between the atomizing electrode 2 and the counter electrode 3 to be set at a given value for electrostatically atomizing water supplied onto the atomizing electrode 2, the electrostatic atomizer according to the third embodiment illustrated in FIG. 6 is operable to allow a potential of the atomizing electrode 2 to be set at a ground potential or at a value closer to the ground voltage than that of a potential of the counter electrode 3, in the same manner as that in the first and second embodiments.

Preferably, in the third embodiment, a voltage is applied in such a manner that an absolute value of a voltage to be applied to the atomizing electrode 2 smaller than that of a voltage of the counter electrode 3 is set within ±1 kV, and an absolute value of a voltage of the counter electrode 3 becomes greater than that of a voltage of the atomizing electrode 2, as with the first and second embodiment.

Although not illustrated, when water is supplied onto the atomizing electrode 2 by means of force feed means, such as a pump or a water head, in an operation of applying a voltage between the atomizing electrode 2 and the counter electrode 3 in such a manner as to allow a potential difference between the atomizing electrode 2 and the counter electrode 3 to be set at a given value for electrostatically atomizing water supplied onto the atomizing electrode 2, the electrostatic atomizer is operable to allow a potential of the atomizing electrode 2 to be set at a ground potential or at a value closer to the ground voltage than that of a potential of the counter electrode 3, in the same manner as that in the aforementioned embodiments. Specifically, in the case of using a water head, the atomizing electrode comprises a tubular atomization nozzle having a taper-shaped tip end. This atomization nozzle has a rear end in fluid communication with a liquid reservoir. The liquid reservoir reserves a liquid (water), and the water is supplied onto the atomizing electrode based on a pressure caused by a water head difference therebetween. Alternatively, the liquid in the liquid reservoir may be forcedly supplied using a pump.

Preferably, in this case, a voltage is applied in such a manner that an absolute value of a voltage to be applied to the atomizing electrode 2 smaller than that of a voltage of the counter electrode 3 is set within ±1 kV, and an absolute value of a voltage of the counter electrode 3 becomes greater than that of a voltage of the atomizing electrode 2, as with the aforementioned embodiments.

As described above, an inventive electrostatic atomizer comprises a high-voltage applying section adapted to apply a high voltage between an atomizing electrode and a counter electrode so as to electrostatically atomize water supplied onto the atomizing electrode. In this electrostatic atomizer, the high-voltage applying section is operable to set an absolute value of a voltage to be applied to the atomizing electrode smaller than an absolute value of a voltage to be applied to the counter electrode.

The voltage to be applied to the atomizing electrode may be preferably within ±1 kV.

Also, the voltage to be applied to the atomizing electrode may be preferably greater than the voltage to be applied to the counter electrode.

Further, the voltage to be applied to the atomizing electrode may be preferably smaller than the voltage to be applied to the counter electrode.

Moreover, the voltage to be applied to said atomizing electrode may be zero V.

In these constructions, when a voltage is applied between the atomizing electrode and the counter electrode to allow negative ions to be generated by the atomizing electrode during an operation of producing charged fine water droplets by electrostatic atomization, the counter electrode becomes a positive electrode, and therefore most of the negative ions generated by the atomizing electrode will be attached onto the counter electrode. Further, when a voltage is applied between the atomizing electrode and the counter electrode to allow positive ions to be generated by the atomizing electrode during the operation of producing charged fine water droplets by electrostatic atomization, the counter electrode becomes a negative electrode, and therefore most of the positive ions generated by the atomizing electrode will be attached onto the counter electrode. Thus, the negative ions (or the positive ions) never excessively attach onto a physical object, such as an inner wall of a structural member defining a mist-receiving space or an article stored in the mist-receiving space, and the physical object becomes less likely to be electrostatically charged. This makes it possible to avoid causing discomfort due to static charges even if a user touches the physical object by his/her hand.

In this specification, an element or component described in the form of means for achieving a certain function is not limited to a specific structure, configuration or arrangement disclosed in the specification to achieve such a function, but may include any other suitable structure, configuration or arrangement, such as a unit, a mechanism or a component, capable of achieving such a function.

The invention claimed is:

1. An electrostatic atomizer, comprising:

a high-voltage applying section adapted to apply a high voltage between an atomizing electrode and a counter electrode so as to electrostatically atomize water supplied onto said atomizing electrode, wherein said high-voltage applying section is operable to set an absolute value of a voltage to be applied to said atomizing electrode, smaller than an absolute value of a voltage to be applied to said counter electrode, and to set a potential of said atomizing electrode at a value closer to a ground potential than a potential of said counter electrode, but not at the ground potential.

2. The electrostatic atomizer as defined in claim 1, wherein said absolute value of said voltage to be applied to said atomizing electrode is greater than zero and within ±1 kV.

3. The electrostatic atomizer as defined in claim 1, wherein said voltage to be applied to said atomizing electrode is greater than said voltage to be applied to said counter electrode.

4. The electrostatic atomizer as defined in claim 1, wherein said voltage to be applied to said atomizing electrode is smaller than said voltage to be applied to said counter electrode.

5. The electrostatic atomizer as defined in claim 1, wherein said counter electrode is provided between said atomizing electrode and a mist-receiving space, an electric flux line is formed by said atomizing electrode and said counter electrode fine water droplets generated by said electrostatic atomization move from said atomizing electrode to the mist-receiving space by inertia of a migration force given by said electric flux line, and ions generated accompanying the generation of the fine water droplets attach onto said counter electrode by a migration force given by said electric flux line.

* * * * *